United States Patent [19]

Victorovich et al.

[11] Patent Number: 4,615,729

[45] Date of Patent: Oct. 7, 1986

[54] FLASH SMELTING PROCESS

[75] Inventors: Grigori S. Victorovich, Toronto; Carlos M. Diaz, Mississauga, both of Canada

[73] Assignee: Inco Limited, Toronto, Canada

[21] Appl. No.: 827,122

[22] Filed: Feb. 7, 1986

[30] Foreign Application Priority Data

Mar. 20, 1985 [CA] Canada ..... 476988

[51] Int. Cl.[4] ..... C22B 15/00

[52] U.S. Cl. ..... 75/21; 75/6; 75/7; 75/23; 75/74

[58] Field of Search ..... 75/6, 7, 21, 23, 74

[56] References Cited

U.S. PATENT DOCUMENTS 3,932,170 1/1976 Shah ..... 75/7

4,104,055 8/1978 Lippert ..... 75/6

*Primary Examiner*—Peter D. Rosenberg

*Attorney, Agent, or Firm*—Francis J. Mulligan, Jr.; Raymond J. Kenny

[57] ABSTRACT

A copper flash smelting process in which part of a sulfidic copper feed is roasted in the presence of a calcareous $SO_2$ scavenger to produce a calcine containing calcium sulfate and an oxidic copper product, the calcine is mixed with additional feed and the mixture is flash smelted to provide a metallic product and a calcareous slag.

7 Claims, 1 Drawing Figure

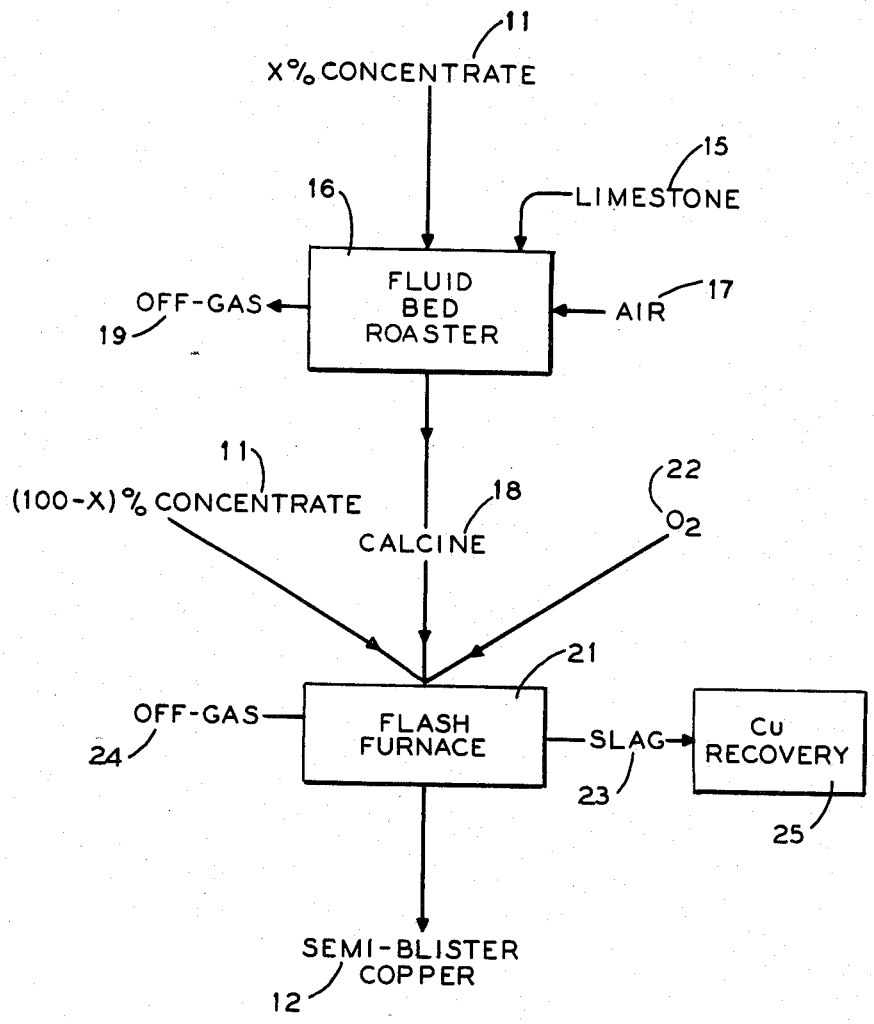
11
X% CONCENTRATE
15
LIMESTONE
16
FLUID BED ROASTER
OFF-GAS
19
AIR
17
11
(100-X)% CONCENTRATE
18
CALCINE
22
O2
21
OFF-GAS
24
FLASH FURNACE
SLAG
23
Cu RECOVERY
25
SEMI-BLISTER COPPER
12

FLASH SMELTING PROCESS

BACKGROUND OF THE INVENTION AND THE PRIOR ART

In U.S. Pat. No. 4,415,356 (the '356 patent) (corresponding to Canadian patent application No. 389,129) there is disclosed a process for autogenous oxygen smelting of sulfide materials containing base metals. The extensive prior art relating to autogenous smelting of copper and nickel sulfide materials is discussed in the '356 patent and the invention described therein is disclosed as:

> "The invention is based on the discovery that in the oxidation smelting the matte grade generated in the smelting furnace can be controlled by dividing the metal sulfide material stream to be smelted such that a portion of the stream is subjected to at least partial or even dead roasting, is then mixed with additional fresh metal sulfide material before being fed to the flash smelting furnace along with flux in the usual manner. This technique permits an upgrading in the matte grade produced, and is particularly applicable to oxygen flash smelting."

The '356 patent goes further to state:

> "It will be appreciated that the roasting step which forms part of the invention may be accomplished in equipment such as a fluid bed roaster. When this is done, a gas containing at least 10% of sulfur dioxide is produced which may be employed as feed for a sulfuric acid plant. In this way sulfur removed from the portion of concentrate which is roasted can be recovered and is not discharged to the atmosphere. Roasting in the fluid bed can be accomplished using air as the oxidant.
>
> The blend of roasted and dry unroasted concentrate, mixed with silicious flux, is injected into the smelting furnace in a stream of oxygen. The desired composition of matte to be obtained can be controlled by adjusting the ratio of calcine to green sulfide material in the feed. For a given concentrate, heat balance calculations will dictate the relative proportions of calcine and green sulfide material which have to be fed to yield the desired product on autogenous smelting."

Thus, the '356 patent discloses a process in which sulfur dioxide is a product of the roasting step and that silicious flux is mixed with the blend of roasted and unroasted concentrate and injected into the smelting furnace. The '356 patent also considers possible variations in the disclosed process in the following language:

> "It is preferred to dead roast only a proportion of concentrate fed to the smelter since in the way materials handling is minimized. Similarly, other sulfide materials equivalent in general metallurgical characteristics to sulfide concentrates, e.g., furnace mattes, can be treated in accordance with precepts of the invention. As noted hereinbefore, for a given sulfide material and a given furnace a sufficient amount of oxygen per unit weight of sulfides must be provided to supply the heat balance of the operation. Thus, for a given sulfide material, heat balance calculations will establish the relative proportions of calcined and uncalcined material to be employed, matte grade, or whether the given sulfide material is treatable by oxidation smelting. It will be apparent from the foregoing description that oxidation smelting, e.g., autogenous oxygen flash smelting, can be carried out in two stages. Thus copper concentrate can be flash smelted in a first operation to matte grade of about 55% while producing a slag which can be discarded; the matte can be granulated, ground and smelted in a second flash melter to yield white metal or blister copper with the slag from the second flash smelter being returned to the first smelter operation. Alternatively, the slag from the second operation can be slow cooled, concentrated and the concentrate returned. Calcine can be fed to either or both of the flash smelting operations along with the sulfide feed in accordance with heat balance requirements and to control product grade therefrom."

In gaining experience with the process of the '356 patent, applicant has found that the silica-based slags used in the patented process require a difficult slag cleaning operation in an electric furnace or slow cooling and flotation of copper metal to achieve good cooper recovery. In addition, when blister copper is produced from iron-containing materials, the silica-based slags are viscous and contain high magnetite concentrations.

OBJECT OF THE INVENTION

It is an object of the invention to provide a process for autogenous smelting of sulfide materials which is improved compared to the process of the '356 patent.

DRAWING

The drawing is a schematic representation of the process of the present invention.

GENERAL DESCRIPTION OF THE INVENTION

The present invention contemplates a process for producing a metallic copper product at least as rich in copper as white metal from a sulfidic copper material comprising autogenously combusting in a bounded space a mixture of said sulfidic copper material and a controlled amount of the product of preroasting sulfidic copper material with a calcareous $SO_2$ scavenger. The roasted sulfidic copper material is roasted at a maximum temperature of about 1000° C. in the presence of an $SO_2$ scavenger selected from the group of lime and limestone.

It is preferred to carry out the autogenous combustion step of the process of the present invention in an INCO-type flash furnace as disclosed in Canadian Patent No. 503,446 (corresponding to U.S. Pat. No. 2,668,107.) Oxygen is fed along with the preroasted and sulfide feed to the bounded space in an amount sufficient to (1) oxidize any oxidizable iron in the copper material, (2) to oxidize at least that amount of sulfur in the sulfidic copper material in excess of about an atomic ratio of total copper to sulfur of 2 and (3) in association with the controlled amount of said product to maintain a flame temperature in excess of about 1350° C. By taking these steps, one thereby (a) produces a molten iron-free copper product at least as rich in copper as white metal, (b) produces a low viscosity, calcareous, sulfur-free molten slag phase containing essentially all the iron and silica introduced into said flash smelting apparatus and (c) produces a gas phase highly enriched in sulfur dioxide. The preroasted and sulfidic copper materials are usually parts of the same material but if desired, may be different. Preferably the copper product is at least as rich in copper as semi-blister copper definable as metallic copper containing a visible amount of white metal and containing up to about 1.5% sulfur.

In the present description, autogenous combustion in a bounded space is specifically disclosed as flash smelting in an INCO-type flash smelting furnace. However, the present invention is applicable to any type of furnacing where the sulfur and iron, if any, content of the feed constitutes the fuel to maintain furnace temperature and provide substantially all the heat necessary for carrying out the reaction. Examples of suitable furnaces include vortex furnaces, shaft furnaces, etc. The only basic criteria of suitable furnaces are that they confine the reactants and liquid products and that they enable gaseous products rich in sulfur dioxide to be treated prior to atmospheric discharge.

The process of the present invention is illustrated in the drawing which schematically represents the treatment of a chalcopyrite concentrate 11 to form a semi-blister copper product 12. X% concentrate 11 is charged with limestone 15 into roaster 16. Roaster 16, which may be any convenient type of roaster, e.g. a fluid bed roaster, is maintained at a temperature of about 850° C. to 1000° C. and the well-mixed feed therein is reacted with air 17 to provide a calcine 18 comprised principally of calcium sulfate and copper ferrite and an off-gas 19 rich in carbon dioxide and poor in or even devoid of sulfur dioxide. Calcine 18 is then fed along with (100-X) % concentrate 11 into flash furnace 21 in a stream of oxygen 22. Flash smelting takes place autogenously in flash furnace 21 at a temperature of at least about 1350° C. to produce a lime ferrite slag 23, semi-blister copper 12 and a sulfur dioxide-rich gas 24. The semi-blister copper is tapped as a product and slag phase 23 is tapped and passes to copper recovery unit 28.

Those skilled in the art will appreciate that the process of the invention as described in conjunction the drawing can be varied substantially without departing from the ambit of the invention. For example, instead of dividing a chalcopyrite concentrate into two parts, various concentrates or matte products depending on the availability of material could either be calcined or could bypass calcination to provide any flow of material as desired. Chalcopyrite could be calcined and bornite, chalcocite or a matte concentrate or product could supply direct feed to the flash furnace. Alternatively, bornite, chalcocite or a matte concentrate could be calcined with direct furnace feed consisting of any one or more available sulfidic copper concentrates or mattes. Considering calcination, limestone can be any low magnesia commercial grade of available material. Alternatively or in addition, lime can be used as an admixture prior to roasting. Roasting can be carried out using air or air enriched with oxygen as the oxidizing medium so long as the roasting temperature is maintained at a maximum of about 1000° C. At temperatures above 1000° C. calcium sulfate will start to decompose and agglomeration of copper-containing oxidic product will result. Roasting at temperatures below about 850° C. is normally very slow and incomplete. In flash smelter 21 the copper product grade is generally determined by the ratio of gaseous oxygen to sulfur in the solid fed to the smelter. Copper product usually ranges from white metal ($Cu_2S$), through semi-blister to blister copper. Whether or not the flash smelting process is autogenous to any given product is determined by the grade of the unroasted sulfidic material, the amount of calcined material and the amount of available oxygen. In autogenous smelting which can be carried out in any conventional way, fuel can be added if the process is not fully autogenous and inerts, e.g., copper cement or the like can be added if cooling is necessary. While it is desired to use copper-containing coolants where avialable, the present invention also contemplates use of conventional coolants such as water, recirculated $SO_2$, cooled slag, etc. in instances where auxiliary cooling is necessary. In addition, if needed, additional lime or limestone can be added to the flash furnace.

Lime ferrite slag produced in flash smelter 21 is normally of low viscosity even though it may contain large amounts of $Fe_3O_4$. When large amounts of magnetite are present in the slag, it is advantageous to reduce the slag with coke, pyrites natural gas or any other convenient reducing agent after the slag is removed from furnace 21 to reduce copper oxide therein and facilitate copper recovery. With respect to lime ferrite slags, contents of silica in the feed materials entering the present process are important in that (A) there is a limited area in the $FeO$-$Fe_2O_3$-$CaO$ ternary diagram which represents lime ferrite slags molten at temperatures below about 1300° C. and that (B) reaction of lime with silica excludes such reacted limes from contributing to the $FeO$-$CaO$-$Fe_2O_3$ system. It is advantageous that the lime-base slag produced in the process of the invention have a ferric to ferrous ratio no greater than about 2.5 in order to be self-reducing with respect to copper oxide while the slag is in the liquid state. This $Fe^{3+}/Fe^{2+}$ ratio permits rapid slag cooling and adequate metallic copper formation by self reduction provided that the slag liquidus temperature is low enough to permit reduction to take place in the liquid phase. This self reduction is especially effective if the $Fe_2O_3$-$FeO$-$CaO$ portion of the slag approximates in weight percent 21% $CaO$, 47% $Fe_2O_3$ and 32% $FeO$ and contains on cooling, the phase $CaO$-$FeO$-$Fe_3O$ (CM). If too much lime is withdrawn from this portion of the slag, for example, as $2CaO$-$SiO_2$ the melting point in the $Fe_2O_3$-$FeO$-$CaO$ system will exceed 1300° C. and, if at the same time, the $Fe^{3+}$ to $Fe^{2+}$ ratio increases, the phase $4CaO$-$FeO$-$4Fe_2O_3$ (CFF) appears on cooling, which phase is usually associated with undesirable high tailings loss of copper in slag cleaning. Slags containing an amount of $FeO$ greater than 32% (by weight) have a greater tolerance for lower lime in the $CaO$-$FeO$-$Fe_2O_3$ system while maintaining a melting point below 1300° C. However, such slags are difficult to obtain given the normal oxidizing environment of an autogenous smelting furnace.

PREFERRED EMBODIMENTS

In the present invention a mixture of about 1 to 1.3 weight ratio of chalcopyrite concentrate and limestone is dead roasted in a roaster at 850° C. to 1000° C. in air. The sulfur from the concentrate forms $SO_2$ and reacts with $CaO$ produced from the decompositions of the limestone. About 90% of the sulfur in the concentrate is captured by the calcine. Thus the exit gas from the roaster typically contains the $CO_2$ from the limestone decomposition and less than 1% $So_2$. This gas can bypass an acid plant. The calcine on the other hand contains mainly $CaSO_4$ and $CuFe_2O_4$. This calcine is mixed with additional copper concentrate and flash smelted with oxygen to produce white metal or blister copper. A ratio of around 0.70 parts of the above roasted calcine to 1.0 parts of green concentrate is required for the oxygen flash smelting to be autogenous to semi-blister. Note that by roasting the limestone with the copper concentrate that no $CO_2$ is released in the flash smelting furnace while virtually all (95%) of the sulfur in the original copper concentrate exits the flash furnace as $SO_2$ at about 70% $SO_2$ and can be readily recovered by compression to liquid $SO_2$ or by conversion to $H_2SO_4$ in an acid plant. $CaSO_4$ decomposition in the hot 1350° C. plus temperature of the flash flame is virtually complete. The slag produced in the flash furnace contains between 3 and 10% copper, has a $Fe^{3+}/Fe^{2+}$ ratio of approximately 3 to 2.5/1 and very little sulfur. This slag is very fluid in this highly oxidized state. The slag can be skimmed from the vessel and cleaned in a variety of ways. Since the lime slags remain fluid over a wide range of $O_2$ partial pressures, the copper can be rapidly reduced from the slag.

The process is further described by the following examples.

EXAMPLE 1

A green copper concentrate containing, wt. %: 27.3 Cu, 1.1 Ni, 32.7 Fe, 34.1 S, 1.72 $SiO_2$, 0.5 $Al_2O_3$, 0.3 MgO and 0.3 CaO, and a finely ground limestone containing wt. %: 54.8 CaO, 0.60 MgO, 0.37 $SiO_2$, 0.11 $Al_2O_3$ and 0.27 Fe were blended in the weight proportion of 100:133. The blend was then pan roasted with continuous raking in air atmosphere at 850° C. The roasting resulted in a fluxed calcine of the following composition, wt. %: 12.8 Cu, 0.5 Ni, 14.2 Fe, 12.7 S total, 37.7 $SO_4^{=}$, 29.5 CaO, 0.5 MgO, 0.9 SiO, 0.3 $Al_2O_3$ and 0.14 $CO_3^{=}$. About 90% of the concentrate sulfur reported to this calcine which consisted of two major phases, namely, $CaSO_4$ and $CuFe_2O_4$. Thus, during the roasting operation practically all of the concentrate sulfidic sulfur was oxidized and most of it was fixed in the form of calcium sulfate. On the other hand, practically complete decomposition of calcium carbonate took place, most of which was converted into calcium sulfate. A blend of 100 parts of the above green copper concentrate with 70 parts of the fluxed copper calcine was then autogenously flash smelted with oxygen in a miniplant flash furnace at a solid feed rate of 9.1 kg/h. This test was aimed at producing white metal and conducted at a free board temperature of 1360°-1420° C. After 1.5 h the test was terminated and final products were allowed to settle during 25 minutes. It was then discovered that a collecting crucible contained a liquid matte at 1220° C. and liquid slag at 1280° C. The products had the following compositions, wt. %:

| | Cu | Ni | Fe | $S_{total}$ | $SO_4^{=}$ | CaO | MgO | $SiO_2$ | $Fe_3O_4$ |
|---|---|---|---|---|---|---|---|---|---|
| Matte | 79.8 | 1.45 | 0.49 | 19.5 | — | — | — | — | — |
| Slag | 4.4 | 0.49 | 42.0 | 0.09 | 0.1 | 23.3 | 1.8* | 9.8* | 49.3 |

*Approximately ⅔ of this came from refractories.

Thus, the flash smelting test provide conclusively that the calcium sulfate was complete decomposed resulting in CaO, which entered the slag as a flux, and all of the calcium sulfate sulfur reported to the exhaust gases together with sulfur dioxide being formed as a result of oxidation of green copper concentrate with oxygen.

EXAMPLE 2

The same materials in the same proportions as in Example 1 were used for roasting and flash smelting tests, but in this test the oxygen input was increased by 7 wt. % relative to the green concentrate-fluxed calcine blend, and measures were taken to prevent the slag from contamination with silica. Under similar experimental conditions of the smelting, the following final products were produced, wt. %:

| | Cu | Ni | Fe | $S_{total}$ | CaO | MgO | $SiO_2$ | $Fe_3O_4$ |
|---|---|---|---|---|---|---|---|---|
| Metal | 95.6 | 0.73 | 0.03 | 1.66 | — | — | — | — |
| Slag | 10.0 | 0.86 | 40.4 | 0.10 | 20.9 | 1.41 | 3.74 | 58 |

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A process for producing copper metal comprising roasting a first sulfidic copper material in the presence of a calcareous sulfur dioxide scavenger to produce an oxidic copper product and calcium sulfate and thereafter combusting a second sulfidic copper material with oxygen in a bounded space in the presence of said oxidic copper product and calcium sulfate to produce copper metal, a lime slag containing essentially all silica and iron charged to said bounded space and an off-gas rich in sulfur dioxide.

2. A process as in claim 1, wherein said first and second sulfidic copper material are substantially identical.

3. A process as in claim 2, wherein the sulfidic copper material is a sulfidic ore concentrate.

4. A process as in claim 3, wherein said ore concentrate is essentially a chalcopyrite concentrate.

5. A process as in claim 1, wherein said calcareous $SO_2$ scavenger is limestone and roasting also produces an off-gas rich in $CO_2$.

6. A process as in claim 1, wherein combusting in a bounded space is carried out in a flash furnace.

7. A process as in claim 1, wherein said first sulfidic copper material, said oxidic copper product, said calcium sulfate and any auxiliary coolant are so proportioned along with oxygen to provide as product a copper metal at least as rich in copper as semi-blister copper.

* * * * *